US005127538A

United States Patent [19]

Bach

[11] Patent Number: 5,127,538

[45] Date of Patent: Jul. 7, 1992

[54] RECYCLING INSERT

[76] Inventor: Judith Bach, 258 Colony Green Dr., Bloomingdale, Ill. 60108

[21] Appl. No.: 736,470

[22] Filed: Jul. 26, 1991

[51] Int. Cl.[5] ..... B65F 1/06; B65D 25/10

[52] U.S. Cl. ..... 220/529; 248/101; 220/909; 220/475; 220/551; 220/528; 220/404

[58] Field of Search ..... 248/124, 907, 101, 99, 248/97; 220/908, 404, 475, 551, 528, 529, 909

[56] References Cited

U.S. PATENT DOCUMENTS

| | | | |
|---|---|---|---|
| 203,891 | 5/1878 | Conway | 248/124 |
| 678,387 | 7/1901 | Flakker | 248/101 |
| 1,353,330 | 9/1920 | Erickson | 248/101 |
| 1,727,448 | 9/1929 | Schario et al. . | |
| 2,161,624 | 6/1939 | Hoerr | 220/551 |
| 2,470,694 | 5/1949 | Foo | 248/124 |
| 2,500,466 | 3/1950 | Myers . | |
| 2,720,346 | 3/1953 | Cypher . | |
| 2,995,329 | 8/1961 | Talcott . | |
| 3,185,422 | 5/1965 | Spindler | 248/124 |
| 3,977,450 | 8/1976 | Schampier | 220/404 |
| 4,559,747 | 12/1985 | Engel | 248/907 |
| 4,750,638 | 6/1988 | Sosower . | |
| 4,821,903 | 4/1989 | Hayes . | |
| 4,834,253 | 5/1989 | Crine . | |
| 4,848,709 | 7/1989 | Kiniry | 248/101 |
| 4,856,740 | 8/1989 | MacLeod et al. | 248/97 |
| 4,867,328 | 9/1989 | McCarthy . | |
| 4,905,853 | 3/1990 | Strawder . | |
| 4,934,637 | 6/1990 | Guerrera | 248/101 |
| 4,946,118 | 8/1990 | Hastings . | |
| 4,967,900 | 11/1990 | Gossett . | |
| 4,978,018 | 12/1990 | Wood . | |

FOREIGN PATENT DOCUMENTS

| | | | |
|---|---|---|---|
| 154396 | 12/1953 | Australia | 220/475 |

OTHER PUBLICATIONS

Advertisement in Harriet Carter gift catalog for "Recycle Mate," catalog No. B3273.

*Primary Examiner*—Stephen Marcus
*Assistant Examiner*—S. Castellano
*Attorney, Agent, or Firm*—Niro, Scavone, Haller & Niro

[57] ABSTRACT

An insert is provided for partitioning a container and for retaining two or more bags within the container. The insert includes a stable, expanding base, a telescoping, vertical support member connected to the base, at least one telescoping, horizontal arm connected to an upper portion of the support member, and at least one telescoping, horizontal leg connected to a lower portion of the support member.

7 Claims, 2 Drawing Sheets

RECYCLING INSERT

BACKGROUND OF THE INVENTION

This invention relates to an apparatus used in dividing containers into compartments.

As a matter of local policy in some communities, and state governmental requirement in other communities, trash must be sorted into at least two, and sometimes three, categories as it accumulates. For examples, glass bottles must be sorted from plastic, which must in turn be sorted from other varieties of waste. It has proved impractical for many householders to designate an entire trash can for each category of waste. To assist the householder, a variety of aids have been proposed over many years for sorting waste as it accumulates. No particular application has met with widespread acceptance, apparently due to factors of cost, economy of space and convenience.

For example, U.S. Pat. No. 4,821,903 to Hayes discloses a trash bin cart having a number of adjacent containers, and a common lid. However, such a device takes up more space than most homeowners would be willing to allocate to temporary trash storage.

U.S. Pat. No. 4,750,638 to Sosower discloses a trash can divided into compartments in which an extensible divider is placed across the top opening. U.S. Pat. No. 4,867,328 to McCarthy also disclosed a trash container perforated with holes to allow division into one or more compartments. However, each of these patents, and others like them, require the purchase of the trash can disclosed therein, rather than the provision of a device that could compartmentalize an existing trash can.

U.S. Pat. No. 4,967,900 to Gossett and U.S. Pat. No. 4,905,853 to Strawder each disclose dividers which can be affixed to compartmentalize an existing trash. However, both of these patents and others like them, fail to disclose devices which can adjust to fit individual trash receptacles.

SUMMARY OF THE INVENTION

The present invention preserves the advantage of known devices which facilitate the compartmentalization of trash containers. It is directed to solving the problems associated with such prior art devices, some of which are mentioned above, and also provides additional advantages not found in the prior art.

Accordingly, it is one object of the present invention to provide a device for insertion into a container which will serve to compartmentalize the container.

A second object is to provide a device which can be adjusted to fit containers of varying shapes and sizes.

A third object is to provide a device which can be placed into a relatively small space.

A fourth object is to provide a device which will be relatively inexpensive to manufacture and sell.

A fifth object is to provide a device which is collapsible and thus easily portable.

Other objects consistent with the specification will be recognized as being achieved by the present invention.

The present invention consists of an insert for partitioning a container, and for retaining two or more bags within the container. The invention includes a stable base for insertion into the container. The base rests on the bottom surface of the container. A telescoping and vertically extending support member with upper and lower portions is provided, and is connected to the base. At least one telescoping and horizontally extending arm having proximal and distal portions is also provided; the proximal portion of the arm is connected to the upper portion of the support member.

In a preferred embodiment, the support member includes means, such as a collar, for fixing the height of the support member. The base is ring-shaped and expandable. The base may also include a channel for slidably accommodating a distal portion of the legs. Further, the distal portion of the arm can include a horizontally extending flange for abutting the sides of the container. The telescoping arms and base can be pivotable so that the unit can be collapsed into elements which are generally parallel to each other.

BRIEF DESCRIPTION OF THE DRAWINGS

The novel features of this invention are set forth with particularity in the appended claims. The invention, together with its objects and the advantages thereof, may best be understood by reference to the following description taken in conjunction with the accompanying drawings, in which like reference numerals identify like elements in the figures and in which:

DETAILED DESCRIPTION OF PREFERRED EMBODIMENT

Figure 1:
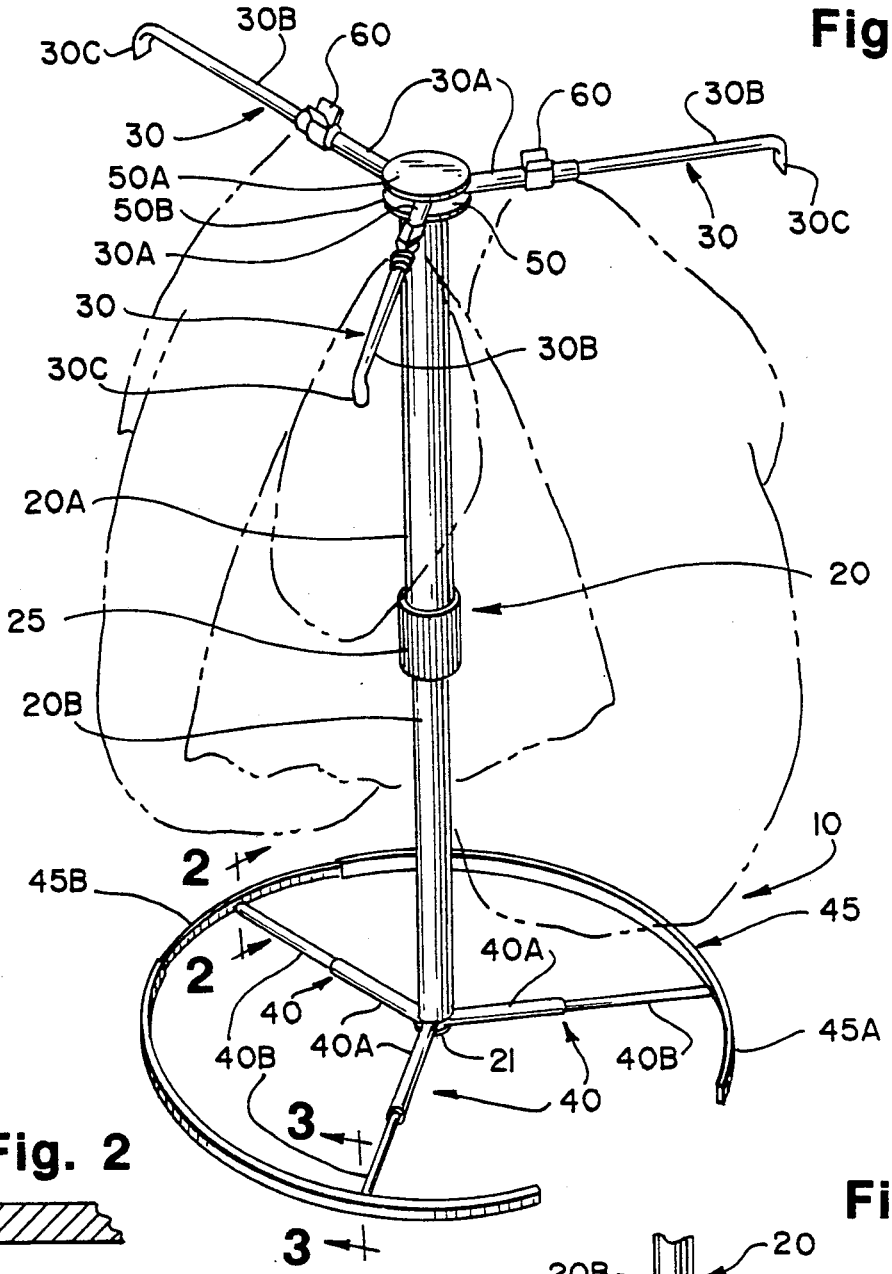
FIG. 1 is a perspective view of one embodiment of the device of this invention.
Figure 2:
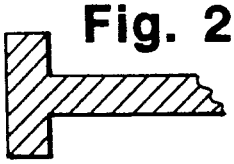
FIG. 2 is a side cross-sectional view taken along section line 2—2 of FIG. 1.
Figure 3:
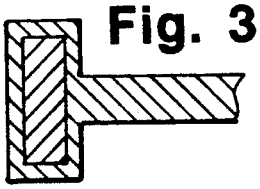
FIG. 3 is a side cross-sectional view taken along section line 3—3 of FIG. 1.

Referring now to the drawings, the present invention is directed to an insert for dividing containers, and particularly waste containers such as garbage cans, into compartments to facilitate the recycling of garbage.

Referring to FIG. 1, the invention includes a base, generally designated 10, a telescoping pillar 20, and telescoping arms 30. Base 10 includes telescoping legs 40, as well as an expanding circular ring 45. Telescoping legs 40 each include a hollow main leg portion 40A, and a secondary leg portion 40B slidably insertable within main leg portion 40A.

Figure 5:
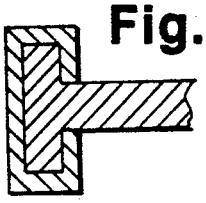
FIG. 5 is a side cross-sectional view taken along section line 5—5 of FIG. 4.
Figure 4:
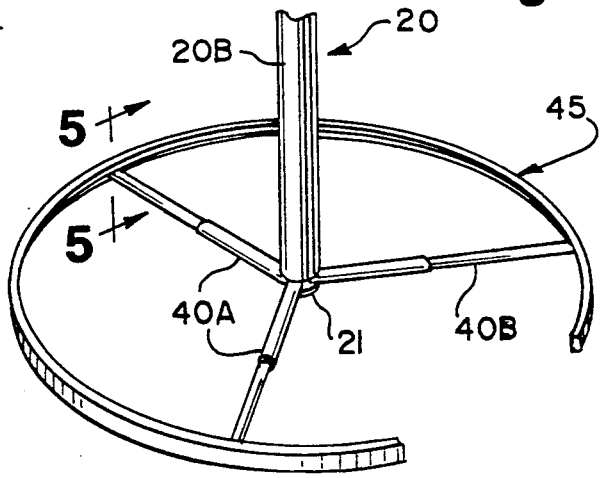
FIG. 4 is a perspective view of a second embodiment of the base of the device of this invention.

FIGS. 1 and 4 each illustrate a different embodiment of base 10. In the embodiment shown in FIG. 1, arcuate band 45B is slidably insertable within hollow circular guide 45A. In the embodiment illustrated in FIG. 4, the ends of each of secondary leg portions 40B include a T-shaped flange (not shown) which is slidably insertable within a channel or recessed portion of circular ring 45. This connection is shown in FIG. 5. Therefore, it can be understood that each of the embodiments shown in FIGS. 1 and 4 permit circular ring 45 to be expanded or contracted.

Figure 6:
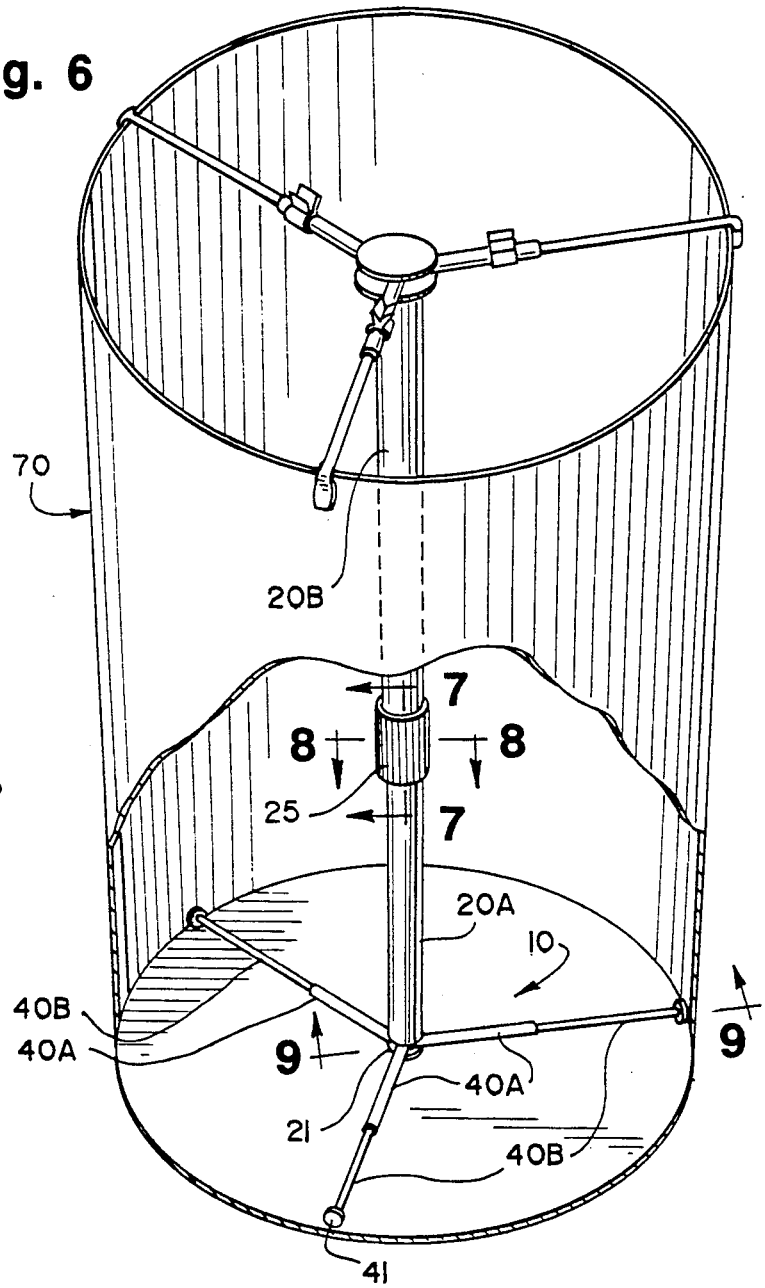
FIG. 6 is a perspective view of a third embodiment of the device o this invention.

Referring again to FIG. 1, telescoping arms 30 each include a hollow main arm portion 30A, and a secondary arm portion 30B which is slidably insertable within main arm portion 30A. Each arm 30 also includes a downwardly extending flange 30C, which can be positioned over the tip of a garbage can or abutted against the inner periphery of the can, to aid in supporting the insert within the can, as shown in FIG. 6. Arms 30 are rotatably connected above pillar 20 at swivel 50, which allows rotation of arms 30 by any well known means. Swivel 50 is, in turn, rigidly connected to, and sits above, pillar 20. Swivel 50 may include two oppositely facing discs 50A and 50B, as shown. Retaining clips 60 are adapted to secure one edge of a sack or bag to each of the arms. In this fashion, two or more bags can be located within a garbage can, as illustrated in FIG. 6. More than one retaining clip 60 can be used on each arm 30. The bottom of pillar 20 consists of flat pillar base 21, which is located so that its bottom edge lies in the same horizontal plane as the bottom surface of circular ring 45. This enables base 10 to provide an even surface for resting against a floor or other support surface, avoiding tilting of base 10.

Figure 9:
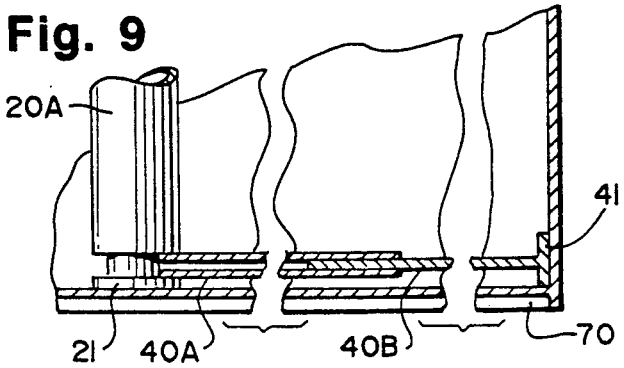
FIG. 9 is a side cross-sectional view taken along section line 9—9 of FIG. 6.

Referring now to FIG. 6, another embodiment of the insert of the present invention is shown contained by a garbage can 70. This embodiment includes another variation of base 10, in which a circular ring or rim is not used. Rather, the distal ends of arm portions 40B are each provided with a flange 41 having a horizontal surface. The horizontal surface of flanges 41 is adapted to abut the inside vertical surface of can 70, allowing base 10 to be secured within can 70. The bottom surface of flange 41 lies in the same horizontal plane as the bottom surface of pillar base 21, preventing tilting of base !0, as shown in FIG. 9.

Figure 7:
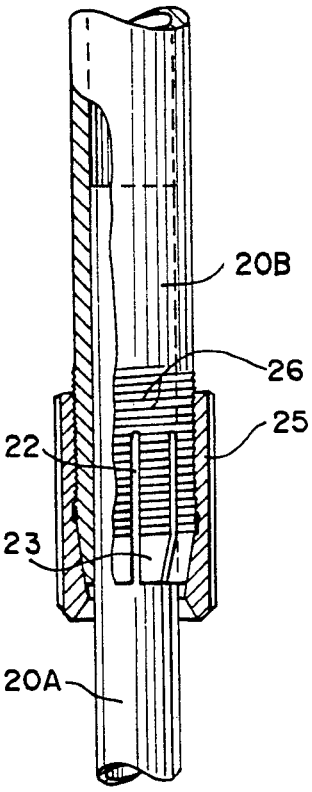
FIG. 7 is a side cross-sectional view taken along section line 7—7 of FIG. 6.
Figure 8:
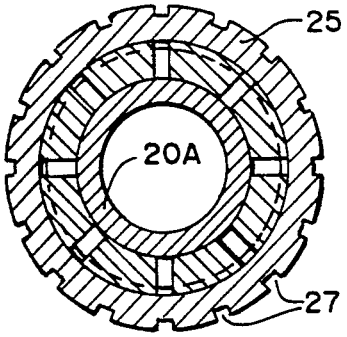
FIG. 8 is a side cross-sectional view taken along section line 8—8 of FIG. 6.

The operation of telescoping pillar 20 will now be described with reference to FIGS. 6–8. Pillar 20 includes first and second pillar sections 20A and 20B, respectively, as well as compressive collar 25. Collar 25 is sized to slide about collar 20A. Collar 25 is internally threaded, and also includes small recesses 27 spaced about its periphery to facilitate gripping of the collar. Collar 25 preferably has an outer rubber coating to enhance frictional gripping contact. Pillar section 20A is sized for slidable insertion within hollow pillar section 20B. The distal end of pillar section 20B includes external threads 26, and tapers as shown in FIG. 7. The distal end of pillar section 20B also includes grooves or slots 22, which form fingers 23.

The adjustment for pillar 20 to secure the pillar at a desired height is well known in the art, and will now be described. Collar 25 is slid up and over pillar section 20A, over the tapered distal end of pillar section 20B, and positioned adjacent threads 26. Collar 25 is then rotated so that its threads cooperate with the threads on pillar section 20B. As collar 25 is rotated, it exerts a compressive force on the distal end of pillar section 20B. This compressive force tends to squeeze fingers 23 about the upper portion of pillar section 20A, rigidly securing pillar sections 20A and 20B within collar 20. By rotating collar 25 in an opposite direction, so that the collar is moved downwardly, the pillar sections can be easily loosened.

It should be understood that other means known by those of skill in the art can be used to telescope arms 30, legs 40, and pillar sections 20A and 20B. Further, known means other than compressive collar 25 can be used to secure pillar sections 20A and 20B together. Such means can include a compressive rubber member, such as a rubber washer, which can be placed over one of telescoping pillar sections 20A and 20B, serving to prevent further sliding of one pillar section within the other. Additionally, a compressive collar can be used to fix the length of arms 30 of legs 40.

An alternative embodiment includes the use of arms 30 and legs 40 which are made to pivot about pillar 20 by any means known in the art, thus allowing the insert of the present invention to be folded into a device whose elements generally lie in the same vertical plane as pillar 20. Also, the base perimeter can be configured into a shape other than an annular ring, such as a square or other suitable shape which will serve to provide stability.

Additionally, in yet another embodiment, swivel 50 need not be used; rather, the juncture of arms 30 can consist of a bent portion, such as a bent wire, which is wider than the hollow sleeve of pillar section 20B. The bent juncture can then be inserted within the sleeve for a tight fit. One or more of arms 30 can also be made of wire, and can be connected by soldering or other means.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A partitioning insert for a container, and for retaining two or more bags within the container, comprising:
   - an annular, circumferentially expandable base for insertion into the container, said base resting on the bottom surface of the container:
   - a telescoping, vertical support member having upper and lower portions, said lower portion connected to said base, and said support member including means for fixing the height of said support member;
   - at least one telescoping, horizontal leg connecting said support member to said base; and
   - at least one telescoping, horizontal arm having proximal and distal portions, said proximal portion connected to said upper portion of said support member, and said arm including means for grasping the bag.

2. The partitioning insert of claim 1 wherein the distal portion of said arm includes a flange adapted to abut the periphery of the container.

3. The partitioning insert of claim 1, wherein the outer perimeter of said base forms an annular ring.

4. The partitioning insert of claim 1, wherein the outer perimeter of said base is an annular ring.

5. The partitioning insert of claim 1, wherein said arm is rotatable about said support member.

6. A partitioning insert for a container, and for retaining two or more bags within the container, comprising:
   - a telescoping, vertical support member having upper and lower portions and including means for fixing the height of said support member;
   - at least two telescoping, horizontal legs connected to said lower portion of said support member; and
   - at least two telescoping, horizontal arms including means for grasping the bag, said arms being rotatable in varying spaced relation to each other about said support member and having proximal and distal portions, said proximal portion connected to said upper portion of said support member, and said distal portion adapted to abut said container.

7. The partitioning insert of claim 6, wherein the distal portion of said arm includes a flange adapted to abut the periphery of the container.

* * * * *